United States Patent [19]

Gillespie

[11] 3,933,079

[45] Jan. 20, 1976

[54] MUSICAL WIND INSTRUMENT

[75] Inventor: Earl Joseph Gillespie, Kenosha, Wis.

[73] Assignee: G. Leblanc Corporation, Kenosha, Wis.

[22] Filed: Sept. 6, 1974

[21] Appl. No.: 503,962

[52] U.S. Cl. ..... 84/388; 84/395

[51] Int. Cl.[2] ..... G10D 7/10

[58] Field of Search..... 84/387, 388, 389, 393–396, 84/399, 398

[56] References Cited

UNITED STATES PATENTS

| | | | |
|---|---|---|---|
| 784,201 | 3/1905 | Barrett | 84/394 UX |
| 977,026 | 11/1910 | Martin | 84/395 |
| 1,006,229 | 10/1911 | Klingler | 84/395 |
| 2,288,743 | 7/1942 | Reed | 84/395 |
| 2,990,744 | 7/1961 | Brilhart | 84/388 X |
| 3,631,755 | 1/1972 | Glantz | 84/388 |

FOREIGN PATENTS OR APPLICATIONS

| | | | |
|---|---|---|---|
| 529,337 | 11/1940 | United Kingdom | 84/394 |
| 21,125 | 8/1905 | United Kingdom | 84/395 |

OTHER PUBLICATIONS

"Really Doubling in Brass," Popular Science, 148 (5): p. 81, May, 1946.

"The Music Trades," 121 (7), p. 103, July, 1973.

*Primary Examiner*—John F. Gonzales

*Attorney, Agent, or Firm*—Olson, Trexler, Wolters, Bushnell & Fosse, Ltd.

[57] ABSTRACT

The embodiment of the invention disclosed herein is directed to a wind instrument made of tubular metal and having an initial straight portion beginning at a mouthpiece receiving end and terminating in a sound-emanating bell portion. The wind instrument is provided with a plurality of piston valves to be manipulated to produce a multitude of different musical notes. A pair of spaced apart tubes is held in a fixed relation relative to one another and to the wind instrument. These tubes have terminating ends extending in a direction opposite that of the mouthpiece receiving end portion. A slide member has a U-shaped end portion which leads into a pair of straight parallel spaced apart portions having open ends fitted over the terminating ends of the tubes and is movable therealong to enable a player to obtain a multitude of different musical notes without manipulation of the piston valves. Lock means is provided between the slide member and the fixed tubes to lock the slide member in a fixed nonmovable position during one instance and to allow release of the slide member for playing of different musical notes during another instance. The sound-emanating bell portion is bent upwardly to allow clearance for movement of the slide member. The mouthpiece receiving end portion is provided with a single slidably adjustable tube portion telescopically inserted therein to provide pitch adjustment for the wind instrument. The singular slidably adjustable tube member is held in a fixed relation by a split-ring clamp associated with the mouthpiece receiving end portion of the wind instrument.

5 Claims, 8 Drawing Figures

11
27
28
29
25
18
18a
50
51
41
42
44
46
40
36
34
33
32
4
47
12
66
8
61
60
13
69
64
68
67

MUSICAL WIND INSTRUMENT

BACKGROUND OF THE INVENTION

This invention relates to musical wind instruments of the brass type, and more particularly to trumpets, or the like, having a plurality of piston keys to be manipulated to produce a multitude of different musical notes.

Heretofore, wind instruments such as trumpets have been provided with U-shaped end members or turning slides frictionally movable relative to one another to provide means for adjusting the musical length of the tube which, in turn, adjusts the musical tone or note obtained from the trumpet. These U-shaped members are generally difficult to move, and are intended to be so, so that once the desired adjustment is obtained it is maintained during normal handling of the musical instrument.

Other wind instruments, such as trombones, provide a slide member which enables the user to obtain a multitude of different musical notes by positioning of the slide member at different locations along its length of travel. The trombone enables the user to obtain an infinite number of tones because of the infinite number of different positions obtainable along its length of travel in contrast to the discrete number of notes obtained from a trumpet as a result of manipulation of its piston valves.

SUMMARY OF THE INVENTION

Accordingly, it is an object of this invention to provide a wind instrument, such as a trumpet, having the musical range of a trumpet but which allows the user to obtain an infinite number of musical notes by the use of a slide member.

Another object of this invention is to provide a new and improved wind instrument with novel locking means between a slide member and a fixed portion of the wind instrument to securely hold the slide member when the wind instrument is to be played by the use of piston valves.

Still another object of this invention is to provide a compact musical instrument such as a trumpet, with a slide member which is capable of a relatively long length of travel without interfering with the sound-emanating bell portion of the musical instrument.

Still another object of this invention is to provide a wind instrument which includes a single slidably adjustable tube member telescopically inserted into the mouthpiece receiving portion of the musical instrument to enable pitch adjustment thereof.

Briefly, a trumpet, constructed in accordance with this invention, is provided with a hand slide that alters the basic pitch by four semi-tones, similar to the first four positions of a slide trombone and is capable of varying all tones played through the standard piston assembly to any degree the player desires. The slide and pistons used at the same time provide unlimited variation of all tones obtainable from the instrument.

The sound-emanating bell portion of the trumpet is curved up to provide clearance for the hand slide when it is extended with either the right hand or the left hand, depending on whether the player prefers fingering the piston assembly with the left hand or right hand. The basic pitch of the musical instrument is established by a unique telescopic mouthpiece receiving tube element telescopically inserted into the mouthpiece receiving portion of the wind instrument. The tube element operates inside the top tube portion of the hand slide, thereby permitting the use of the full length of the mouthpiece taper to produce the proper acoustical compensation for a $B^b$ trumpet, for example. The hand slide is locked by a unique rotary collar which is fashioned to prevent inadvertent removal from the trumpet.

Many other objects, features and advantages of this invention will be fully realized and understood from the following detailed description when taken in conjunction with the accompanying drawings wherein like reference numerals throughout the various views of the drawings are intended to designate similar elements or components.

DETAILED DESCRIPTION OF THE ILLUSTRATED EMBODIMENT

Figure 1:
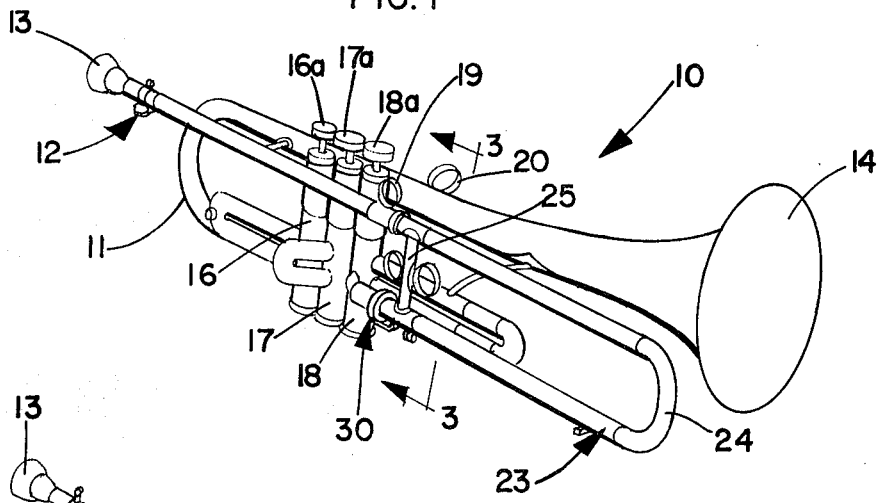
FIG. 1 is a perspective view of a wind instrument constructed in accordance with the principles of this invention.
Figure 2:
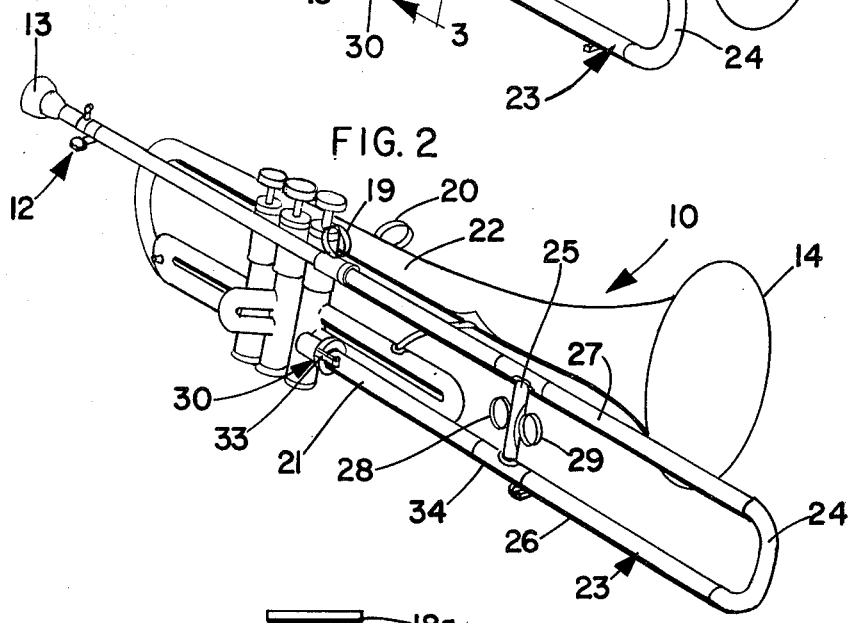
FIG. 2 is another perspective view of the wind instrument of FIG. 1 but with a hand slide member shown in its extended position.
Figure 3:
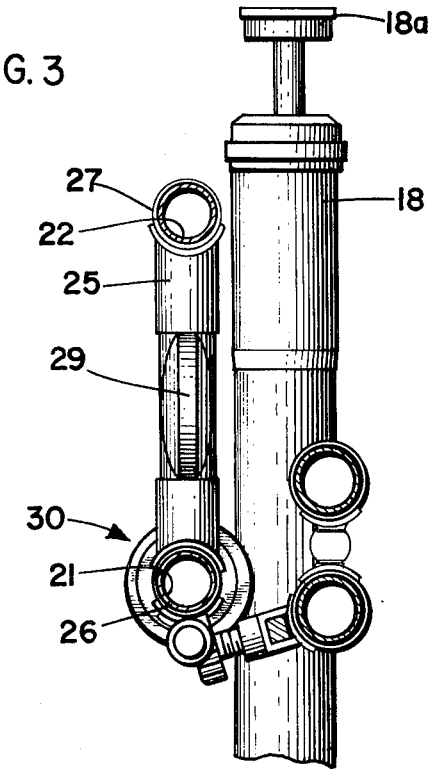
FIG. 3 is a sectional view taken along line 3—3 of FIG. 1.
Figure 4:
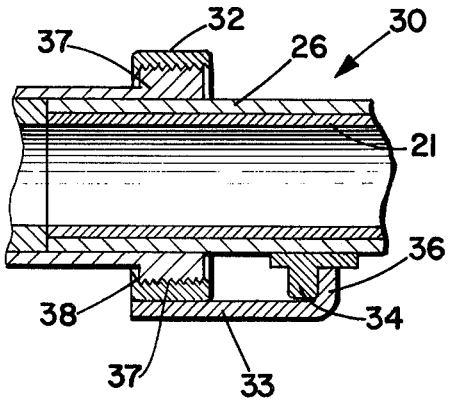
FIG. 4 is an enlarged fragmentary sectional view of the lock member associated with the slide portion of the musical instrument and taken along line 4—4 of FIG. 6.

Referring now to FIGS. 1 and 2 there is seen a musical wind instrument designated generally by reference numeral 10. Preferably, the wind instrument here illustrated is a trumpet. The trumpet is formed of tubular metal 11 having a mouthpiece receiving end portion 12 to receive a mouthpiece 13 in a standard manner. The tubular metal 11 is fashioned in the usual form, having a substantial length of substantially constant diameter and ultimately extending along a gradually opening diameter portion which forms a sound-emanating bell 14.

In a conventional manner a plurality of piston valves 16, 17 and 18 are provided substantially centrally of the wind instrument 10 and include finger keys 16*a*, 17*a* and 18*a*, respectively, associated therewith. As the finger keys are manipulated up and down, and the user blows through the horn, different musical notes will be produced. A finger ring 19 is positioned to enable the user to hold the musical instrument 10 with the right hand while manipulating the finger keys 16*a*, 17*a* and 18*a*. A second finger ring 20 is positioned on the other side of the musical instrument to enable the user to use his left hand to hold the instrument and manipulate the finger keys 16*a*, 17*a* and 18*a*.

In accordance with one aspect of this invention a pair of parallel spaced apart tubes 21 and 22 extend in a direction opposite that of the mouthpiece receiving end portion 12. The parallel spaced apart tubes 21 and 22 are considered to be held in a fixed relation relative to the wind instrument. A slide member 23 has a U-shaped end portion 24 leading into a pair of straight portions 26 and 27 which fit over the ends of the tubes 21 and 22, respectively. A cross bar 25 is provided between the straight portions 26 and 27 and a pair of finger rings 28 and 29 are secured thereto to enable the user to hold the slide member 23 and manipulate the same with either the right or left hand.

To facilitate longitudinal movement of the slide member 23 the bell portion 14 of the musical instrument 10 is turned upwardly, as seen in FIGS. 1 and 2, to provide sufficient clearance for the slide member when in the extended position, as best seen in FIG. 2. While the bell portion 14 is here illustrated as being turned upwardly relative to normal holding position of the musical instrument while it is being played, it will be understood that the bell portion 14 can also be turned to the left if desired.

A first lock means 30 is provided between the lower tube 21 and the lowermost straight portion 26 to hold the slide member in a closed position. The lock means 20 is best illustrated in FIGS. 3, 4, 5 and 6 and includes a rotatable collar 32 having an arm 33 secured thereto and extending forwardly to engage an angularly disposed boss member 34 secured to the straight portion 26. The arm 34 has a turned end 36 which forms a tab-like portion to engage the boss 34 for locking the slide member in place. Most advantageously, the collar 32 is threadedly secured to a threaded end portion 37. To prevent inadvertent removal of the collar 32 a plurality of threads 37 are provided in uniform fashion with an endmost thread 38 being somewhat larger. This provides a reduced inside diameter only at one end portion of the collar to prevent unthreading thereof. Other means may be provided to prevent removal of the locking collar 32 such as by upsetting the last thread thereof.

Figures 5, 6, 7, 8:
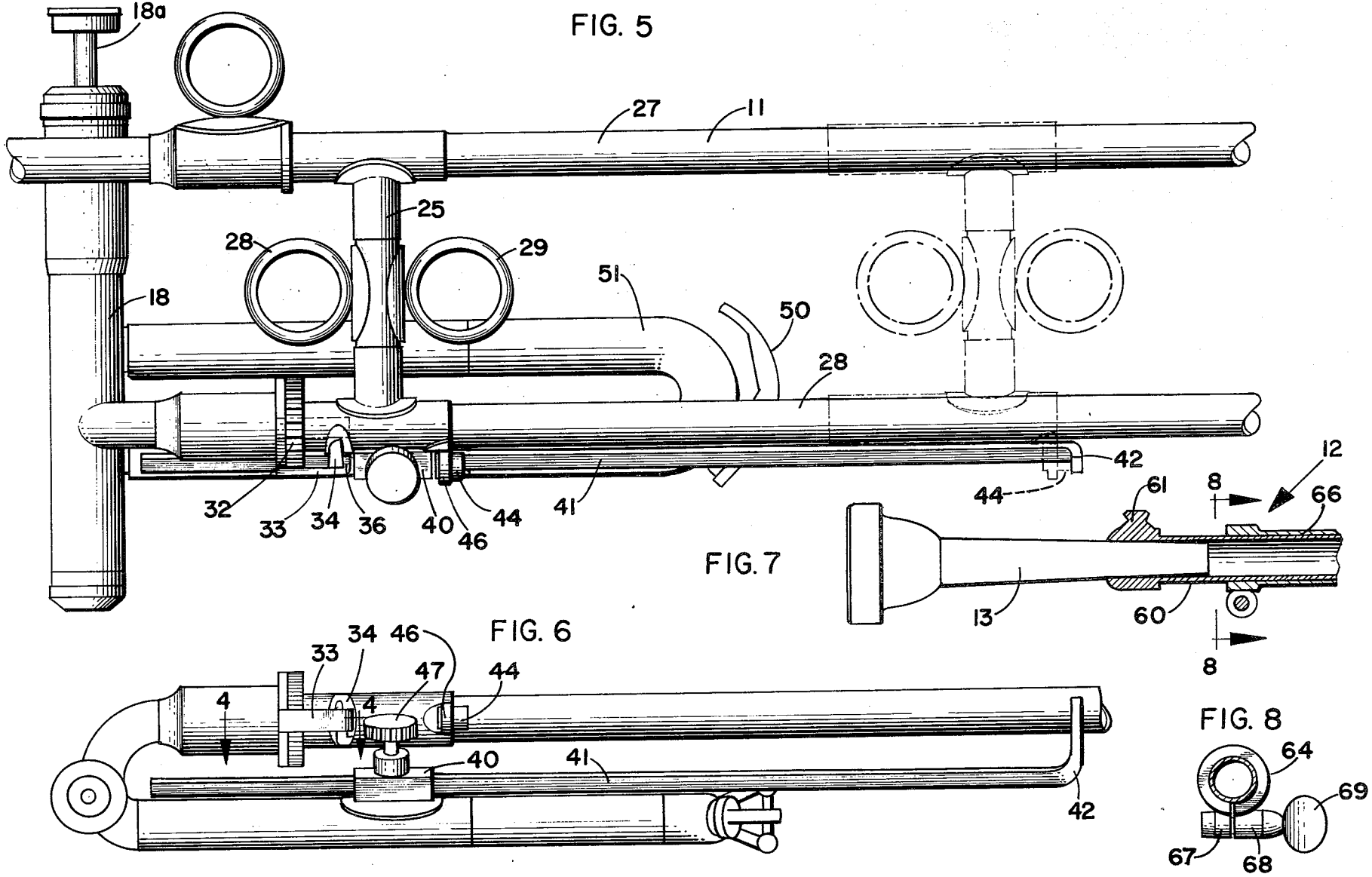
FIG. 5 is an enlarged fragmentary view illustrating the operation of the slide member of the musical instrument of this invention.
FIG. 6 is a bottom view of the portion of the trumpet shown in FIG. 5.
FIG. 7 illustrates the mouthpiece receiving end portion of the trumpet and the straight telescopically adjustable slide member associated therewith for adjusting the pitch of the musical instrument.
FIG. 8 is an end sectional view taken along line 8—8 of FIG. 7.

As seen in FIGS. 5 and 6 a boss member 40 receives an adjustable slide rod 41 which has a turned end 42 selectively positioned so as to limit the length of travel of the slide member 23. A rubber bumper 44 is secured to the slide member through an eyelet element 46. The slide rod 41 is locked in position by a thumb screw 47 threadedly engaging the boss member 40. FIG. 5 illustrates the bumper 44 in phantom line engaging the turned-in element 42 to illustrate the limiting travel of the slide member.

A water key 50 is illustrated in one portion 51 of the tubular metal 11 and is provided in the usual manner to expel accumulated moisture. Other water keys may be provided in the wind instrument but which are not specifically illustrated herein.

In accordance with another aspect of this invention the mouthpiece receiving end 12 has a singular slidably adjustable tube element 60. The extent to which the tube element 60 is withdrawn from the mouthpiece receiving end 12 determines the adjustment of the pitch of the wind instrument. A tab 61 is provided on the slidable tube element 60 to facilitate grasping the tube and pulling it outwardly for adjustment. To lock the tube element 60 in a firm position at the mouthpiece receiving end of the musical instrument, a split ring clamp 64 is provided immediately adjacent the terminating end of an outer sleeve 66. A pair of diametrically opposed spaced apart boss elements 67 and 68 are threaded to receive a thumb screw element 69. The mouthpiece 13 is then inserted directly into the single slidably adjustable tube member 60.

What has been described is a novel wind instrument construction adapted particularly to trumpets, and the like, and which enables the user to obtain a multitude of different musical notes either by operating a plurality of piston keys or by operating a slide element either individually or simultaneously as desired. Accordingly, it will be understood that variations and modifications of this invention may be made without departing from the spirit and scope of the novel concepts disclosed and claimed herein.

The invention claimed is as follows:

1. In a wind instrument formed of tubular material having an initial straight portion beginning at a mouthpiece receiving end and terminating in a sound-emanating bell portion the combination comprising a plurality of piston valves for the playing of different musical notes, a pair parallel spaced apart tubes held in a fixed relation to the wind instrument and having terminating ends extending in a direction opposite that of the mouthpiece receiving end portion, a slide member having a U-shaped portion leading into a pair of straight parallel spaced apart portions having open ends telescoping with said terminating ends of said pair of parallel spaced apart tubes to slide therealong for the playing of different musical notes, and a bar adjustably secured to said wind instrument substantially parallel to said one of said parallel spaced apart tubes and its associated one of said pair of spaced apart straight portions, said bar having terminating end means to engage said slide member thereby limiting the extent of travel of said slide member.

2. A wind instrument as set forth in claim 1 wherein the terminating end means of said bar comprises a laterally bent tip thereon.

3. In a wind instrument formed of tubular material having an initial straight portion beginning at a mouthpiece receiving end and terminating in a sound-emanating bell portion, the combination comprising; a pair of parallel spaced apart tubes held in a fixed relation to the wind instrument and having terminating ends extending in a direction opposite that of the mouthpiece receiving end portion, a slide member having a U-shaped end portion leading into a pair of straight parallel spaced apart portions having open ends fitted over the terminating ends of said pair of said parallel spaced apart tubes to slide therealong for the playing of different musical notes, a bent portion formed in said tubular material immediately adjacent said sound emanating bell portion sufficient to provide clearance for said slide member to enable said slide member to be moved beyond said bell portion, and a bar adjustably secured to said wind instrument substantially parallel to said one of said parallel spaced apart tubes and its associated one of said pair of spaced apart straight portions, said bar having terminating end means to engage said slide member thereby limiting the extent of travel of said slide member.

4. A wind instrument as set forth in claim 3 wherein the terminating end means of said bar comprises a laterally bent tip thereon.

5. A wind instrument as set forth in claim 3 wherein said sound emanating bell portion is bent at an angle whereby said slide member when extended passes closely adjacent to said bell portion.

* * * * *